US006454608B1

(12) United States Patent
Kitahara et al.

(10) Patent No.: US 6,454,608 B1
(45) Date of Patent: Sep. 24, 2002

(54) ADAPTER FOR EXTERNAL CONNECTION AND ELECTRONIC APPARATUS

(75) Inventors: Masaaki Kitahara, Tokyo; Toshiyuki Sekine, Higashiyamato, both of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/690,670

(22) Filed: Oct. 17, 2000

(30) Foreign Application Priority Data

Dec. 27, 1999 (JP) ..... 11-371009

(51) Int. Cl.[7] ..... H01R 25/00; H01R 13/627
(52) U.S. Cl. ..... 439/638; 439/358
(58) Field of Search ..... 439/638, 660, 439/357, 358; 368/10, 204

(56) References Cited

U.S. PATENT DOCUMENTS 4,629,329 A 12/1986 Komiyama
4,648,682 A * 3/1987 Tubbs ..... 339/154
4,915,638 A * 4/1990 Domian ..... 439/142
4,941,838 A * 7/1990 Zinn ..... 439/350
5,199,897 A * 4/1993 Hashiguchi ..... 439/357
5,588,864 A * 12/1996 Lin ..... 439/357
5,727,964 A * 3/1998 Douty et al. ..... 439/372
5,860,826 A * 1/1999 Chang ..... 439/358
5,957,728 A * 9/1999 Wu ..... 439/638
5,993,262 A * 11/1999 Kowdynski et al. ..... 439/638
6,056,579 A * 5/2000 Richards, III et al. ..... 439/358
6,099,359 A * 8/2000 Yamamuro ..... 439/736
6,126,474 A * 10/2000 Doye et al. ..... 439/357
6,146,182 A * 11/2000 Wang et al. ..... 439/357
6,179,642 B1 * 1/2001 Hwang ..... 439/358
6,210,202 B1 * 4/2001 Kuo ..... 439/358

* cited by examiner

*Primary Examiner*—P. Austin Bradley
*Assistant Examiner*—Edwin A. León
(74) *Attorney, Agent, or Firm*—Frishauf, Holtz, Goodman & Chick, P.C.

(57) ABSTRACT

The present invention relates to a connecting adapter 500 for connecting an earphone 600 with a body part 200 of a writs type of music player. In a casing 501, an earphone jack 504, and a circuit board 505 having a continuity with the earphone jack 504 are provided. A connection terminal 506 having a continuity with an earphone connector 205 of the body art 200 is provided so as to penetrate the inside and the outside of the casing 501 and have a continuity with the circuit board 505. On the outer surface of the casing 501, a fixed hook 507 for engaging with a concavity 200*a* of the body part 200 and a movable hook 508 for engaging with a concavity 200*b* of the body part 200, which is incorporated so as to be rotatable and to be biased toward the body part 200, are provided.

14 Claims, 13 Drawing Sheets

ADAPTER FOR EXTERNAL CONNECTION AND ELECTRONIC APPARATUS

BACKGROUND OF THE INVENTION

1. Field of the Invention

The present invention relates to an adapter for external connection, which is used, for example, when a terminal of an earphone is attached to a portable music player, and an electronic apparatus using the adapter for external connection.

2. Description of Related Art

Portable music players have been used for a long time. In these portable music players, a memory medium, such as a magnetic tape or an optical disk, for example, a compact disk (CD), a mini disk (MD) or the like, in which music data are stored, is set in a body part of the player. A music is reproduced on the basis of the music data stored in the memory medium in a reproductive form corresponding to each memory medium, to output the music from an earphone or a headphone. When the music player is operated to reproduce or stop the music, the music player is operated by using operation switches provided on the body part of the player or is remotely controlled by a remote controller provided on an earphone cord.

On the other hand, in proportion to high integration of semiconductor memories and low cost thereof, a portable music player using a semiconductor memory card which is a small and detachable nonvolatile memory, as a memory medium for music data has been developed. In such a portable music player, the body part of the player can be downsized. The portable music player can have a durability against vibration and shock. The portability thereof can be improved.

A terminal of an earphone or a headphone and a terminal attachment portion of the player are standardized. It is restricted that a connecting portion between the terminal and the portable music player is downsized because of the standardization. Therefore, there is a limit to downsizing the portable music player.

In particular, when a user carries the music player without using the music player, the music player is required to be more portable, that is, to be downsized more.

In contrast with the above music player, an adapter for connecting an earphone and an electronic apparatus using the adapter are disclosed in, for example, U.S. Pat. No. 4,629,329. However, in such an adapter and an electronic apparatus, there are some defects in a connection structure between an adapter for connecting an earphone and an electronic apparatus, and the like.

Further, because the terminal and the terminal attachment portion of the music player are standardized, it is difficult that the terminal and the terminal attachment portion have a waterproof structure.

SUMMARY OF THE INVENTION

The present invention was developed in view of these problems. An object of the present invention is to provide an adapter for external connection, which is used, for example, when a terminal of an earphone is attached to a portable music player, and which is easily detachable from the body part of the player, and an electronic apparatus using the adapter for external connection.

Another object of the present invention is to provide an adapter for external connection, which enables a connecting portion between a terminal of an earphone and a portable music player to have a waterproof structure by making the adapter have a waterproof, and an electronic apparatus using the adapter for external connection.

In order to solve the above-described problems, the present invention was accomplished. In accordance with the first aspect of the present invention, an adapter for external connection, comprises:

a connection terminal (506) for contacting with a terminal provided on a surface of a body part of an electronic apparatus when the adapter for external connection is attached to the body part of the electronic apparatus, an external connection terminal (504) which is electrically connected to the connection terminal and which has a continuity with an external lead, an attachment member for attaching the adapter for external connection to the body part of the electronic apparatus, attachably and detachably;

wherein the attachment member comprises a pair of hooks (507 and 508) for engaging with a pair of concavities formed on a side portion of the body part of the electronic apparatus in an outer peripheral direction of the body part, at least one of the pair of hooks being a movable hook (508); and a biasing member (509) for biasing the movable hook toward the other hook to elastically engage the movable hook with one concavity of the body part of the electronic apparatus.

According to the present invention, by using the adapter for external connection, which mediates between the electronic apparatus and the external lead, even in a standardized connection structure, the connection structure between the electronic apparatus and the external lead can be changed while a state in which the connection structure is detachable is kept.

Therefore, for example, in case that a lead of an earphone is connected with a portable music player as an electronic apparatus, when the music player is not used, the portable music player can be downsized by detaching an earphone together with the connecting portion.

That is, when the electronic apparatus is not used, it is possible to carry the body part of the electronic apparatus in a state that the body part is downsized.

Further, according to the present invention, by biasing the movable hook toward the body part of the electronic apparatus with a biasing force caused by the biasing member in order to engage the movable hook with the concavity of the body part of the electronic apparatus, it is possible that the connection terminal has a continuity with the terminal of the electronic apparatus and that the adapter for external connection is fixed to the electronic apparatus at a touch. It is possible to detach the adapter for external connection from the electronic apparatus by pushing the movable hook in a reverse direction of the biasing force.

That is, the adapter for external connection has a structure in which the adapter for external connection is easily attached to and detached from the electronic apparatus.

Because the attachment member comprises a pair of hooks, at least one of the pair of hooks being a movable hook; and a biasing member for biasing the movable hook toward the other hook to elastically engage the movable hook with one concavity of the body part of the electronic apparatus; the adapter for external connection is firmly fixed to the electronic apparatus. Further, it is hard that the adapter for external connection comes off the electronic apparatus.

As a biasing member, for example, a spring member (such as, a torsion coil spring 509 or a plate spring 511) is used.

In the above-described adapter for external connection, the other hook may be a fixed hook (507), the fixed hook may be provided on one end side of the adapter for external connection and the movable hook may be provided on the other end side of the adapter for external connection.

In the above-described adapter for external connection, a hook portion (507*a*) of the fixed hook may project toward the movable hook.

In the above-described adapter for external connection, the connection terminal may comprise a coil spring (506*b*), and the coil spring may give a biasing force to the connection terminal so as to bias the connection terminal toward an output terminal of the body part of the electronic apparatus According to the present invention, the adapter for external connection can be attached to the body part of the electronic apparatus. At the same time, it is possible to ensure the electrical connection between the connection terminal of the adapter for external connection and the output terminal of the electronic apparatus.

In the above-described adapter for external connection, the adapter for external connection may further comprise a circuit board (505) for electrically connecting the connection terminal with the external connection terminal, wherein the circuit board has a continuity with the connection terminal through the coil spring.

According to the present invention, the connection terminal is electrically connected with the external connection terminal. Further, it is possible to give a waterproof function to the adapter for external connection by providing an O-ring or the like.

In the above-described adapter for external connection, the external connection terminal maybe a lead terminal engaging portion (for example, an earphone jack 504) for detachably receiving a lead terminal (for example, an earphone terminal 601) provided on an end portion of the external lead.

According to the present invention, because it is possible that the lead is removed from the main part of the adapter for external connection, the adapter for external connection is more useful.

In the above-described adapter for external connection, the external connection terminal may be a terminal which is fixedly connected with the external lead.

According to the present invention, the external lead is incorporated into the adapter for external connection.

In the above-described adapter for external connection, the adapter for external connection may further comprise a waterproof member (for example, an O-ring 503*f*) for preventing water. from entering the adapter for external connection from the external connection terminal.

In the above-described adapter for external connection, the connection terminal may comprise a waterproof member for a terminal (for example, an O-ring 503*d*), for preventing water from entering the adapter for external connection.

According to the present invention, water cannot enter the adapter for external connection by the function of the go waterproof member. Therefore, the adapter for external connection, which has a waterproof structure can be provided.

In accordance with the second aspect of the present invention, an electronic apparatus comprises:

an adapter (500) for external connection, comprising; a connection terminal (506) for contacting with a terminal provided on a surface of a body part of the electronic apparatus when the adapter for external connection is attached to the body part of the electronic apparatus, an external connection terminal (504) which is electrically connected to the connection terminal and which has a continuity with an external lead, an attachment member for attaching the adapter for external connection to the body part of the electronic apparatus, attachably and detachably; wherein the attachment member comprises a pair of hooks (507 and 508) for engaging with a pair of concavities formed on a side portion of the body part of the electronic apparatus in an outer peripheral direction of the body part, at least one of the pair of hooks being a movable hook (508); and a biasing member (509) for biasing the movable hook toward the other hook to elastically engage the movable hook with one concavity of the body part of the electronic apparatus; and the body part (200) of the electronic apparatus comprising a concavity (200*b*) for the movable hook, for engaging with the movable hook of the adapter for external connection, and the terminal (205*a*) for contacting with the connection terminal of the adapter for external connection when the movable hook is engaged with the concavity for the movable hook.

According to the present invention, when the electronic apparatus is not used, the lead can be easily removed from the body part of the electronic apparatus by detaching the adapter for external connection at a touch. It is possible to downsize the body part of the electronic apparatus.

The electronic apparatus may be a portable type of electronic apparatus. Further, the electronic apparatus may be attachable to user's body.

When the electronic apparatus is a portable type of electronic apparatus or when the electronic apparatus is attachable to user's body, the electronic apparatus is more portable. Further, the electronic apparatus is more useful.

The body part of the electronic apparatus may comprise a band for wearing the body part of the electronic apparatus on user's wrist.

In the above-described electronic apparatus, the external connection terminal may be a lead terminal engaging portion for detachably receiving a lead terminal provided on an end portion of the external lead, and the lead terminal engaging portion may be provided so that the lead terminal is inserted and extracted in a direction approximately parallel to a direction of the band when the adapter for external connection is attached to the body part of the electronic apparatus.

According to the present invention, when a user wears the electronic apparatus on user's wrist and the lead terminal is connected with the lead terminal engaging portion, it is hard that the lead terminal hits on user's forearm in comparison with the case that the lead terminal is inserted and extracted in a direction perpendicular to a direction of the band, and the lead terminal is not obstructive to wearing the electronic apparatus.

PREFERRED EMBODIMENT OF THE INVENTION

A wrist type of music player 100 (electronic apparatus) will be explained as an embodiment of the present invention in detail with reference to figures, as follows.

Figure 1:
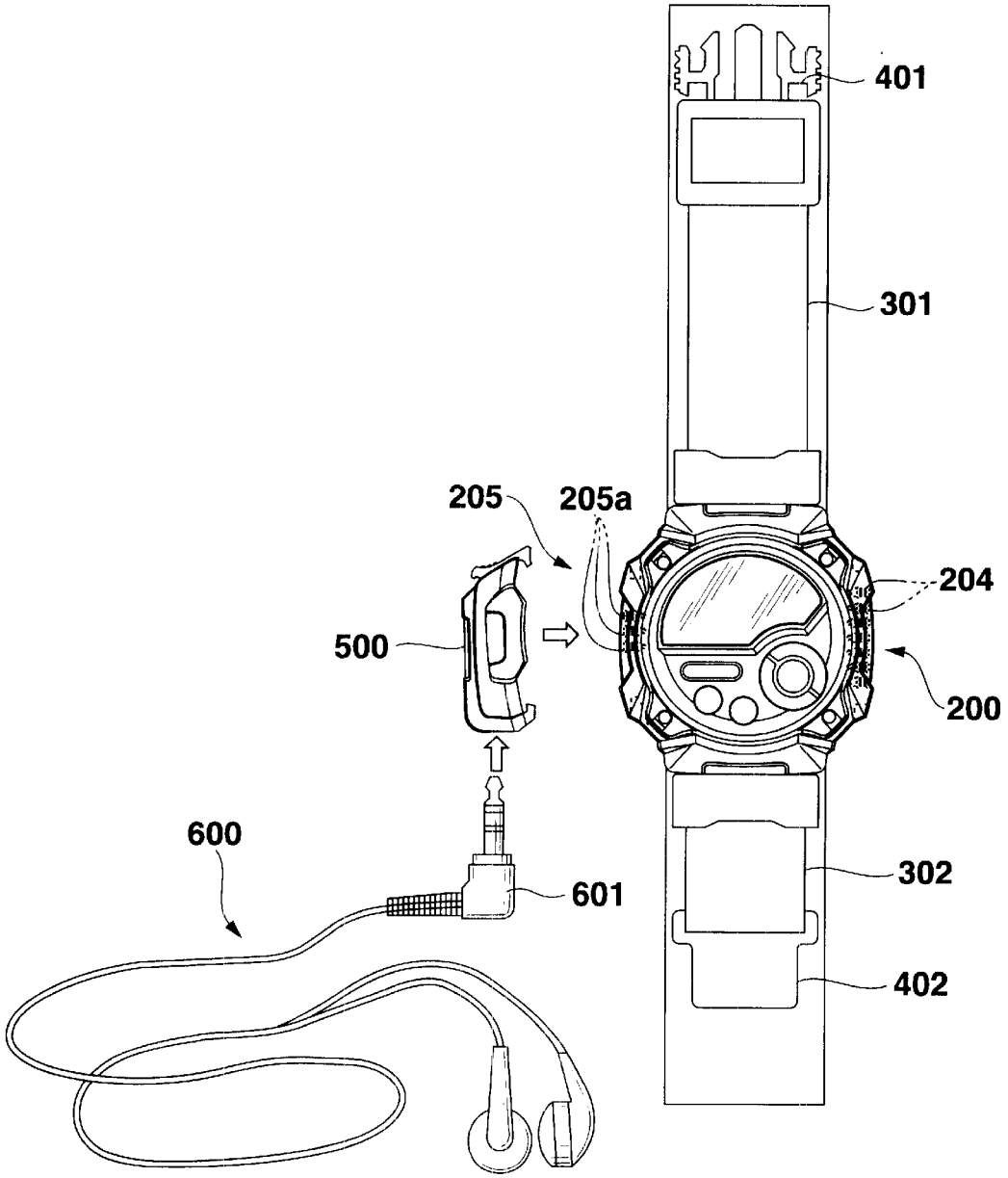
FIG. 1 is a schematic view showing a whole appearance of a wrist type of music player according to an embodiment of the present invention.

FIG. 1 is a schematic view showing a whole appearance of a wrist type of music player according to the embodiment.

Figure 2:
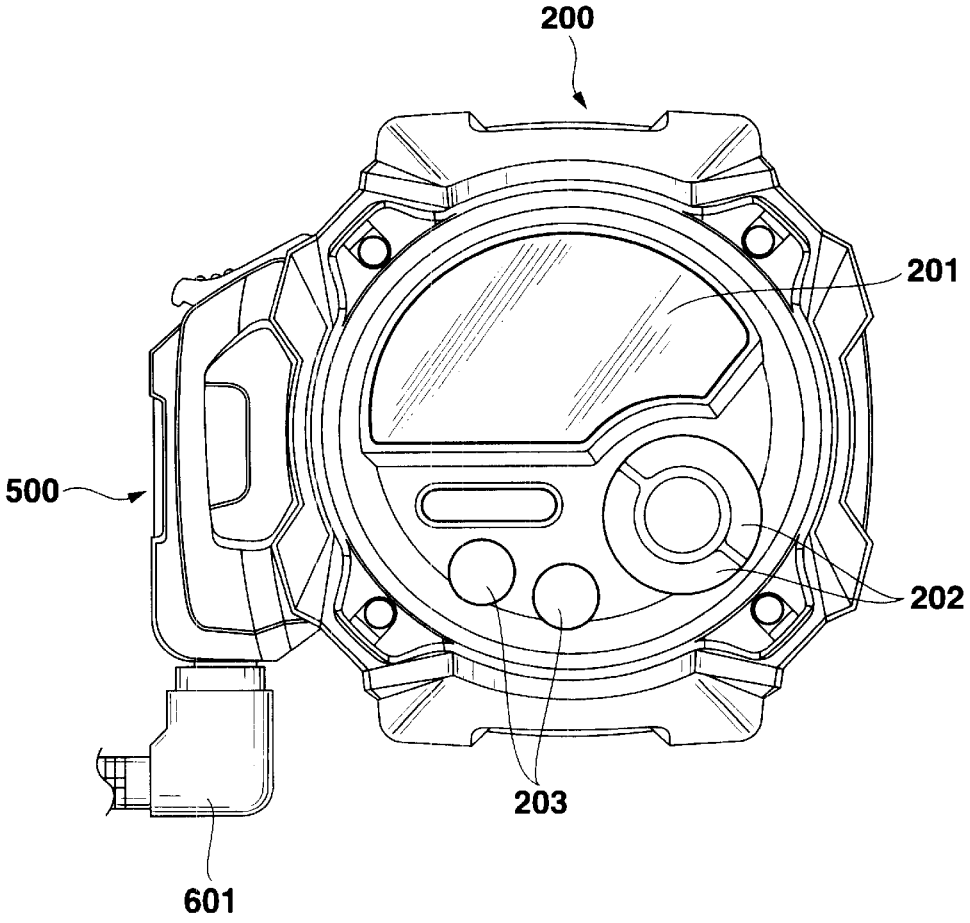
FIG. 2 is a plan view showing a state in which an adapter for connecting an earphone and an earphone are attached to a body part of the wrist type of music player.
Figure 3:
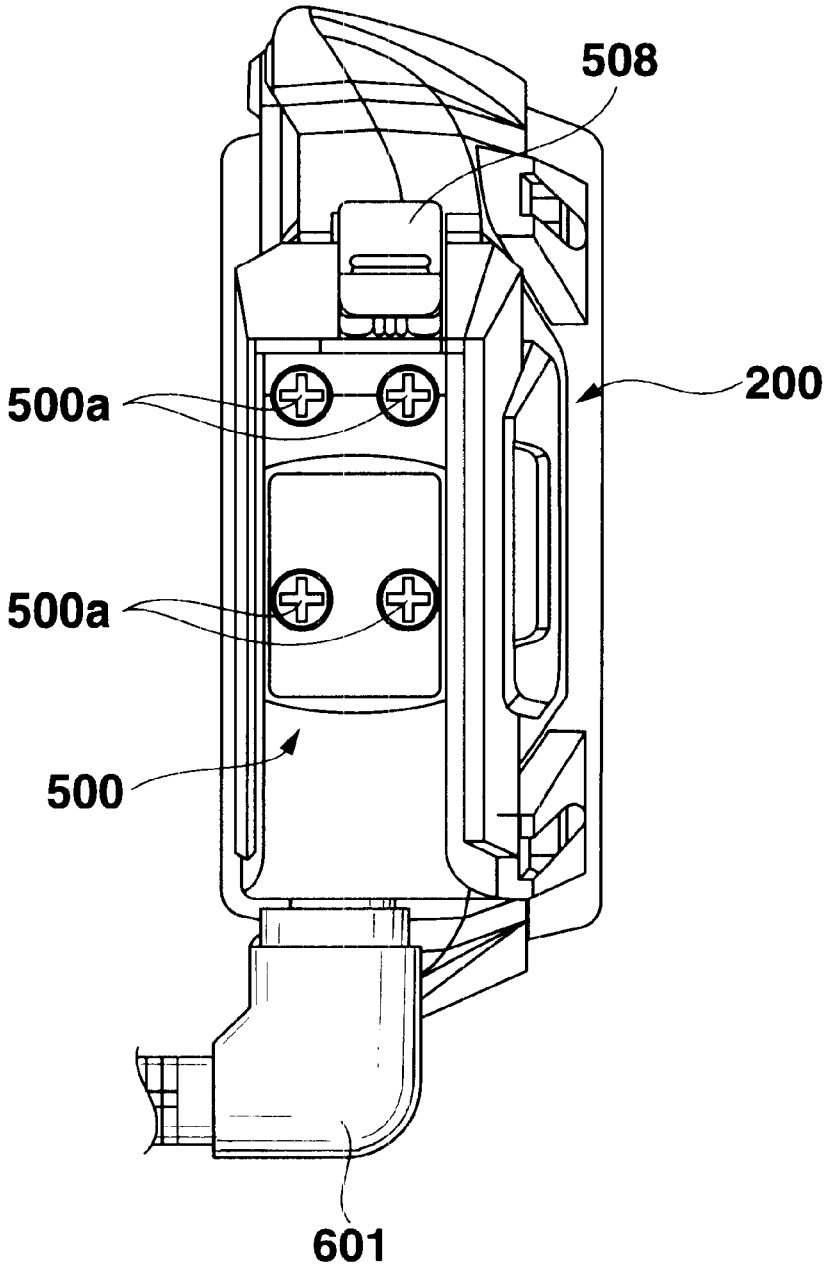
FIG. 3 is one side view showing a state in which the adapter for connecting an earphone and the earphone are attached to the body part of the wrist type of music player.
Figure 4:
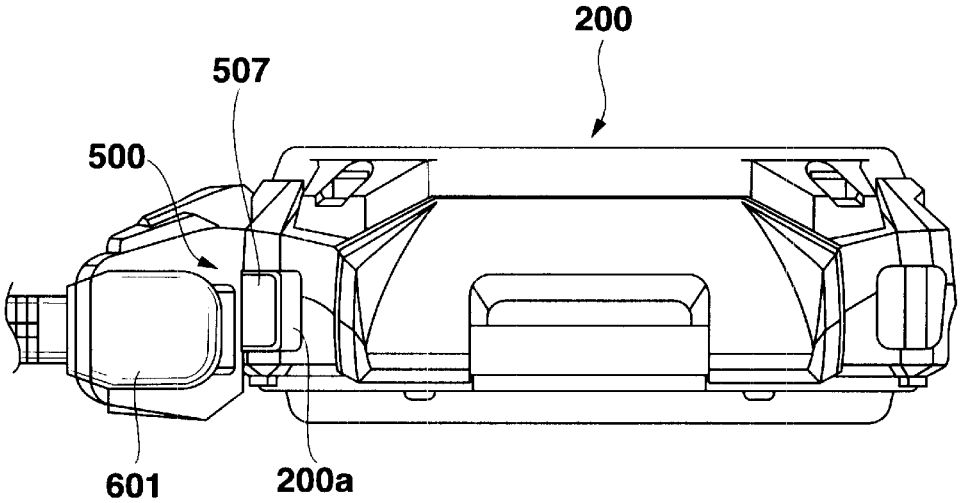
FIG. 4 is a front view showing a state in which the adapter for connecting an earphone and the earphone are attached to the body part of the wrist type of music player.
Figure 5:
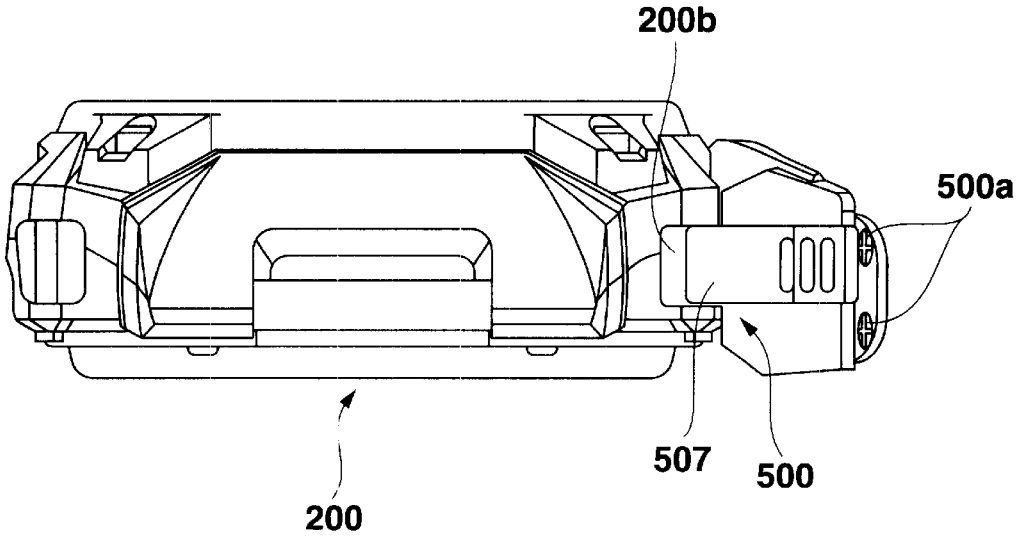
FIG. 5 is a rear view showing a state in which the adapter for connecting an earphone and the earphone are attached to the body part of the wrist type of music player.
Figure 6:
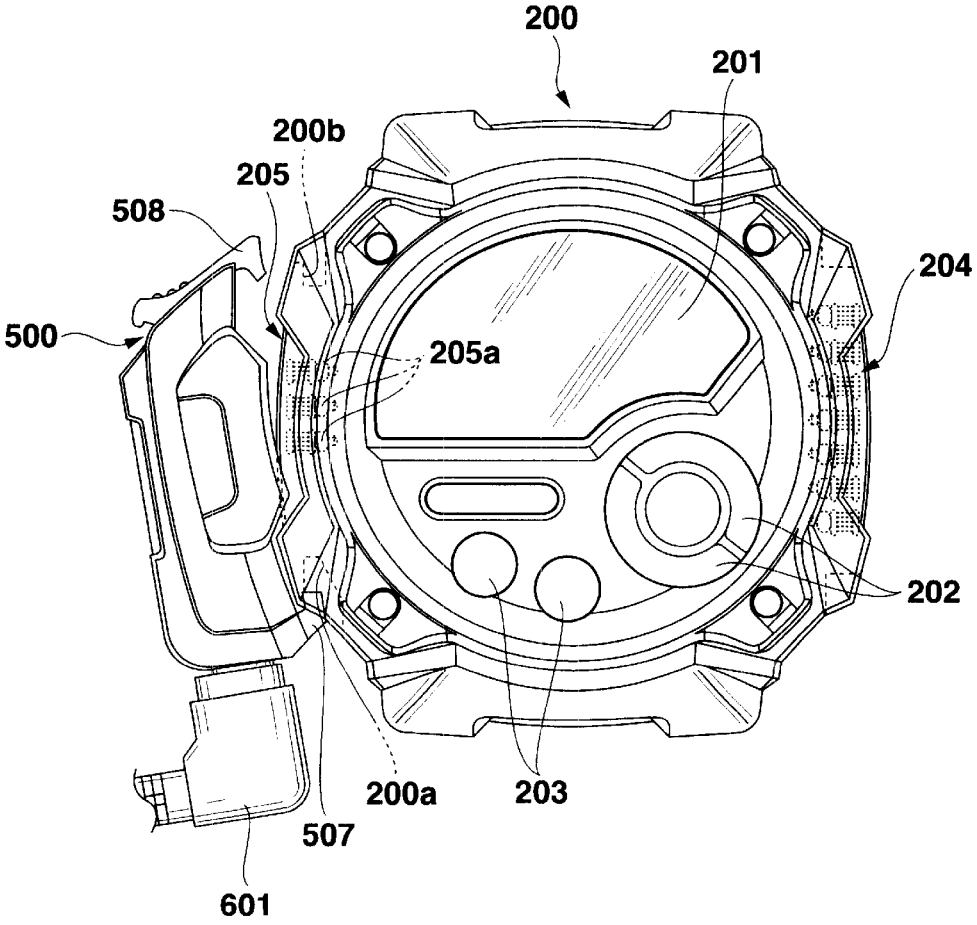
FIG. 6 is a plan view showing a state in which the adapter for connecting an earphone and the earphone are partially detached from the body part.
Figure 7:
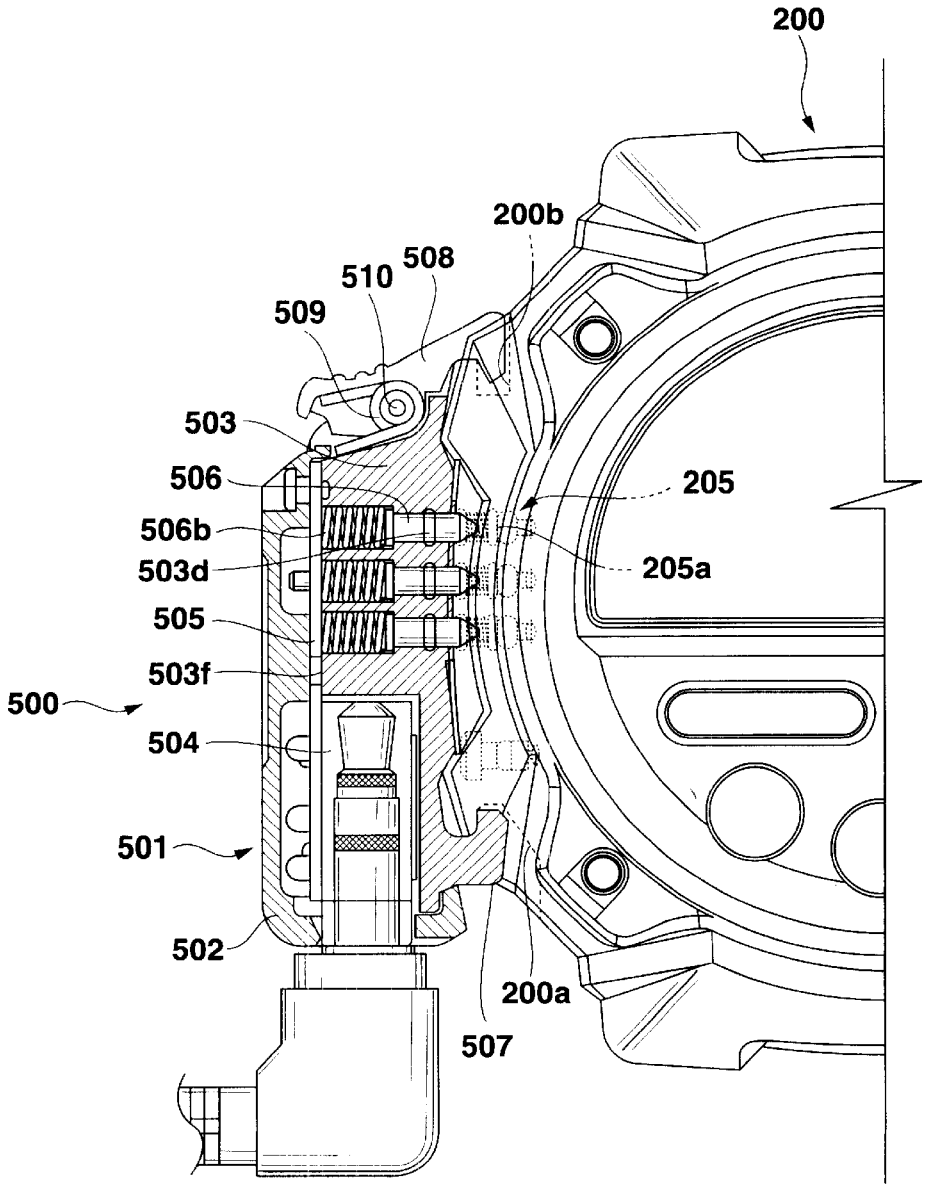
FIG. 7 is an enlarged partially sectional view showing a connecting portion for connecting the body part with the adapter for connecting an earphone and the earphone.
Figure 8:
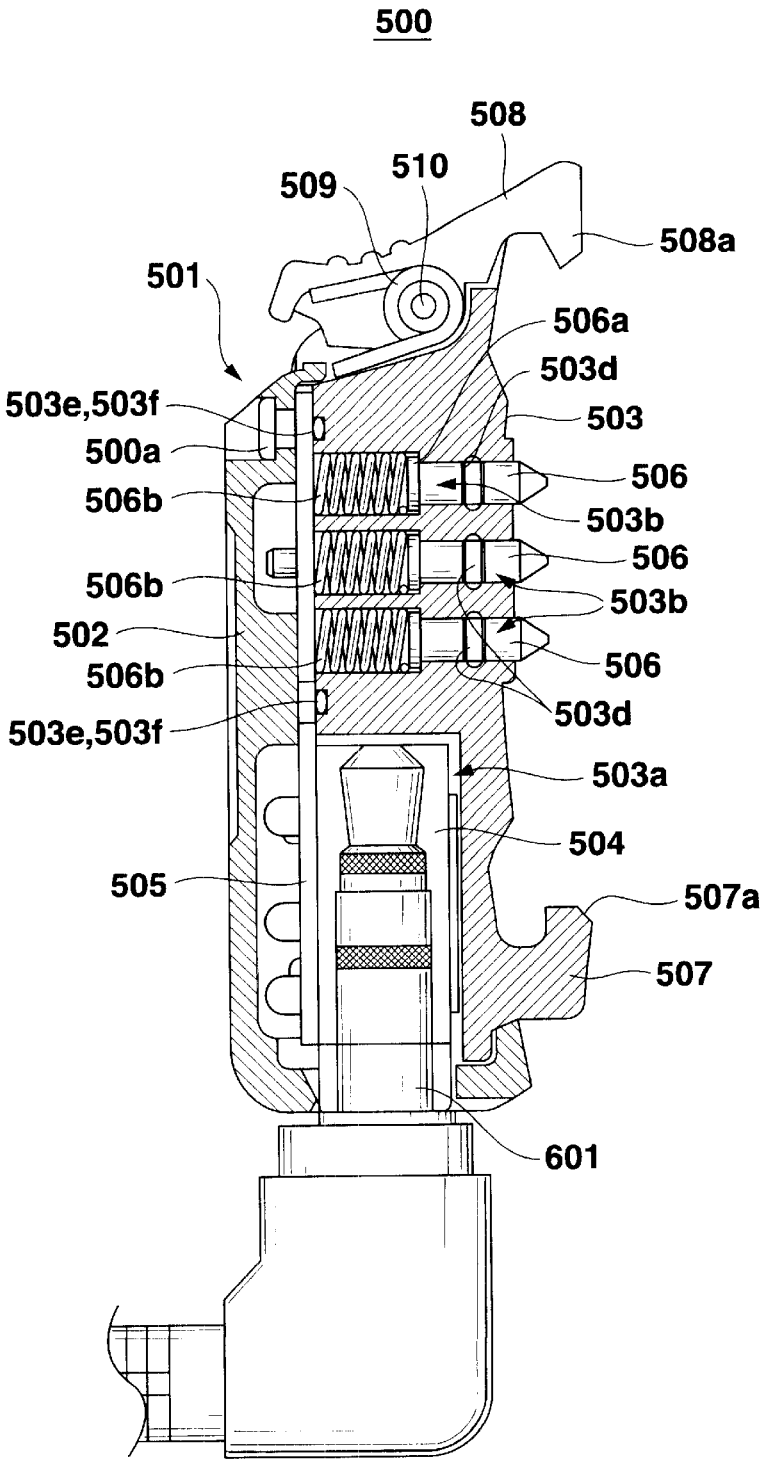
FIG. 8 is a transverse sectional view of the adapter for connecting an earphone.

FIG. 2 is a plan view showing a state in which an adapter 500 for connecting an earphone (adapter for external connection) and an earphone 600 are attached to a body part 200 of the wrist type of music player. FIG. 3 is one side view showing the above state. FIG. 4 is a front view showing the above state. FIG. 5 is a rear view showing the above state. FIG. 6 is a plan view showing a state in which the adapter 500 for connecting an earphone and the earphone 600 are partially detached from the body part 200. FIG. 7 is an enlarged partially sectional view showing a connecting portion for connecting the body part 200 with the adapter 500 for connecting an earphone and the earphone 600. FIG. 8 is a transverse sectional view of the adapter 500 for connecting an earphone. FIGS. 9 to 11, 12A, 12B and 13A to 13C are views showing component parts of the adapter 500 for connecting an earphone.

As shown in FIG. 1, the wrist type of music player is a device having a function of a wrist watch and that of a music player. The wrist type of music player comprises a body part 200 formed approximately into a rectangular parallelepiped, a pair of known band members (hereinafter, referred to as wrist bands 301 and 302) for wearing the body part 200 on a user's body (e.g., a wrist, an upper arm or the like), known buckles 401 and 402 for connecting the wrist bands 301 and 302 so as to be attachable to and be detachable from each other, an adapter 500 for connecting an earphone, which is attached to the body part 200 on one side thereof so as to be attachable to and be detachable from the body 200, and a known earphone 600.

As shown in FIGS. 2 to 6, a display 201, an operation input part 202 and mode switches 203 for being operated when a mode of the music player is set, are provided on the face portion of the body part 200. An external apparatus connector 204 for connecting an external apparatus adapter with the inside of the body part 200, is provided on one side surface side of the body part 200. An earphone connector 205 for connecting the adapter 500 for connecting an earphone, with the inside of the body part 200 is provided on the other side surface side of the body part 200.

Further, a control unit (not shown in the figure) for controlling the body part 200, a memory card (not shown in the figure) for storing a music data, a music data decoder (not shown in the figure) for reproducing a music on the basis of the music data stored in the memory card and a music output unit (not shown in the figure) are incorporated into the body part 200.

For example, as shown in FIGS. 4, 5 and 6, on one side surface of the body part 200, a concavity 200*a* for a fixed hook, for engaging with a fixed hook 507 (explained in detail below) of the adapter 500 for connecting an earphone, and a concavity 200*b* for a movable hook, for engaging with a movable hook 508 (explained in detail below) are provided in an outer peripheral direction of the body part 200. The concavity 200*a* for a fixed hook and the concavity 200*b* for a movable hook are also used in order to fix the body part 200 to the external apparatus adapter.

The display 201 comprises a display screen, such as a liquid crystal display panel or the like. On the basis of a display data input from the control unit, in a watch mode in which the wrist type of music player is operated as a watch, watch information, such as a present time, date, day of the week and the like are displayed. In a music mode in which the wrist type of music player 100 reproduces music data, information relating to a music to be reproduced, such as a title of a music, a name of a singer, play time, lyrics of a music, a number denoting a music data and the like, are displayed on the display screen. In a communication mode, a message indicative of a state in which the body part 200 communicates with an external apparatus, a music-related information corresponding to a music data which is being downloaded, and the like, are displayed.

The surface of the display 201 is protected by a windshield glass.

The operation input part 202 comprises keys for inputting commands relating to a watch function such as the correction of time in a watch mode, commands relating to a music reproduction such as play, stop, rewind, forward, of a music and the like in a music mode, and commands relating to a data communication function, for starting the communication with an external apparatus in a communication mode. The operation input part 202 outputs a signal generated by pushing a key, to the control unit.

The mode switches 203 are ones for setting a watch mode, a music mode or a communication mode. Each mode switch 203 corresponding to each mode is provided. Instead of the above switches, a mode selection menu may be displayed on the display 201. When the mode switch 203 is pushed, a signal generated by pushing the mode switch 203 is outputted to the control unit When a mode is switched and is set by pushing the mode switch 203, the control unit carries out and controls a process corresponding to the set mode (the watch mode, the music mode or the communication mode).

The external apparatus connector 204 comprises input terminals for data transmitted from an external apparatus, such as a PC (personal computer), through the external apparatus adapter. The data (compression-coded music data) transmitted from an external apparatus is stored in a memory card incorporated into the body part 200.

The earphone connector 205 comprises output terminals 205*a* (terminal) for connecting the adapter 500 for connecting an earphone. A music data outputted from a music data encoder and a music data output part which are incorporated into the body part 200, through the earphone connector 205, is outputted to the earphone 600.

As shown in FIGS. 7 and 8, the adapter 500 for connecting an earphone is schematically constructed by a casing 501 having an upper Casing 502 made of synthetic resin and a lower casing 503 made of synthetic resin, the casing 501 being formed approximately into a rectangular parallelepiped; a standarized earphone jack 504 (terminal engaging portion) provided on one end surface of the casing 501, for holding the earphone terminal 601 (lead terminal) inserted therein to; a circuit board 505 held in the casing 501 by sandwiching it between the upper casing 502 and the lower casing 503; connection terminals 506 having a plurality of pins projecting from a plurality of holes 503*b* so as to retreat and protrude, which are provided on the lower surface of the lower casing 503 so as to arrange three holes; a fixed hook 507 provided on one end side of the lower surface of the lower casing 503; a movable hook 508 provided on the other end side surface of the lower casing 503 so as to be rotatable; and a torsion coil spring 509 (spring member) sandwiched between the movable hook 508 and the other end side surface of the casing 501.

Figure 9:
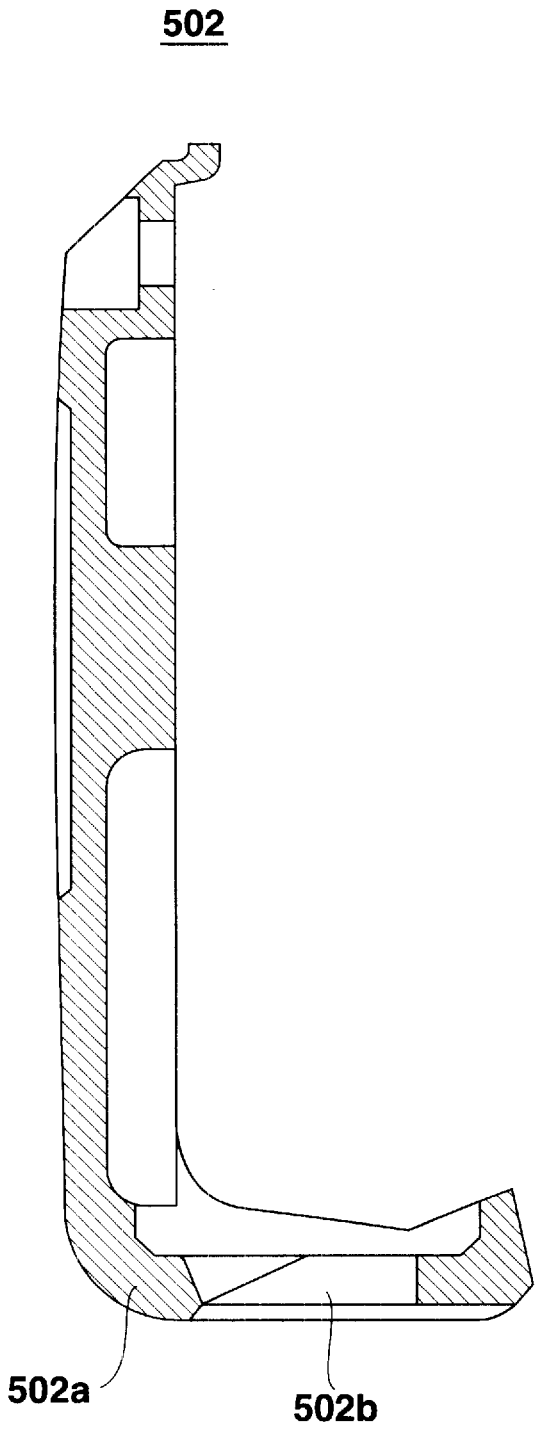
FIG. 9 is a view showing an upper casing of the adapter for connecting an earphone.

As shown in the transverse sectional view of FIG. 9, the upper casing 502 comprises a side wall 502*a* for covering one end side surface side of the lower casing 503 and an opening portion 502*b* provided on the side wall 502*a* in order to receive an earphone terminal 601 (terminal). The diameter of the opening portion 502*b* is smaller than that of the earphone jack 504.

Figure 10:
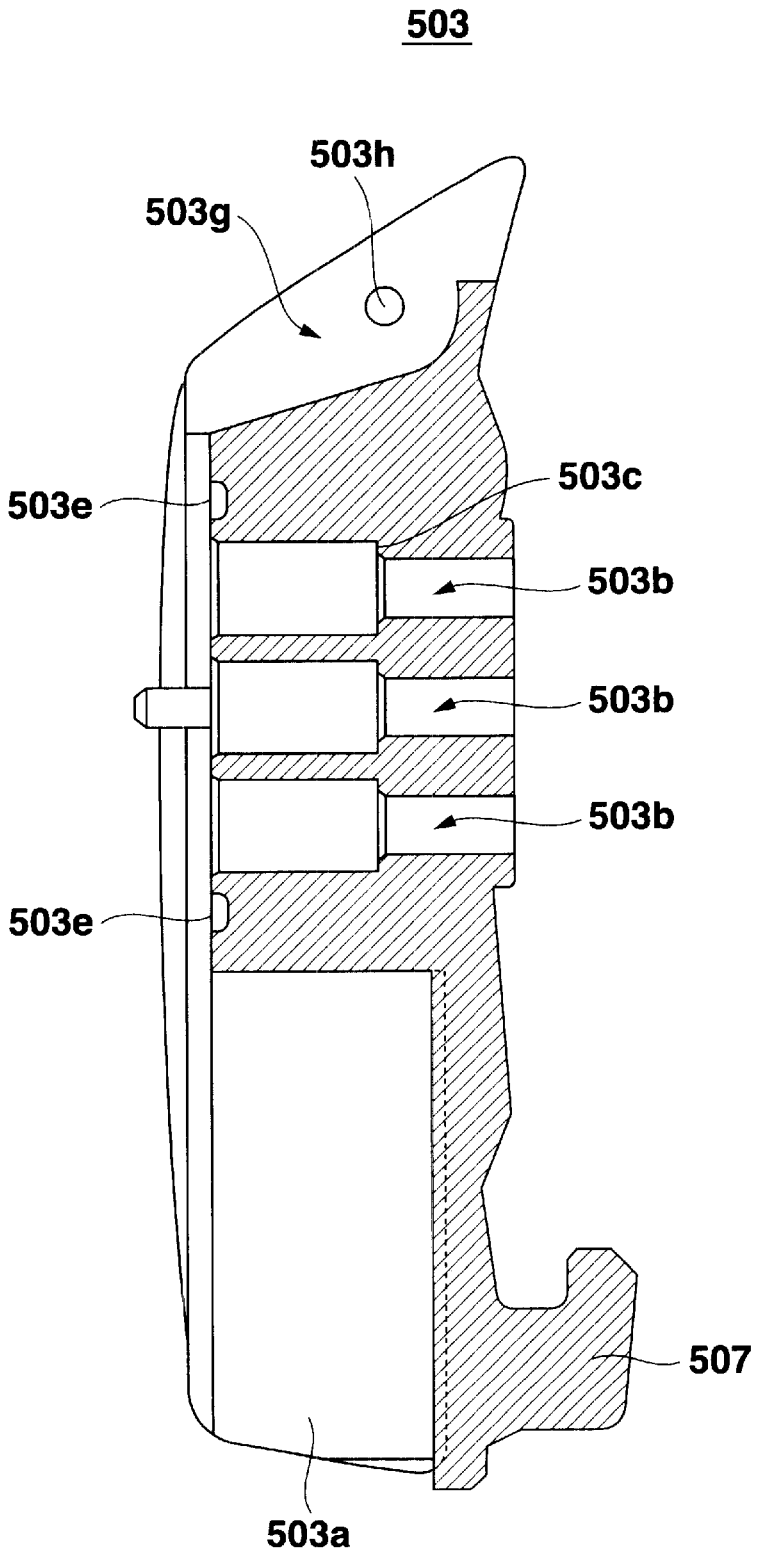
FIG. 10 is a view showing a lower casing of the adapter for connecting an earphone.
Figure 11:
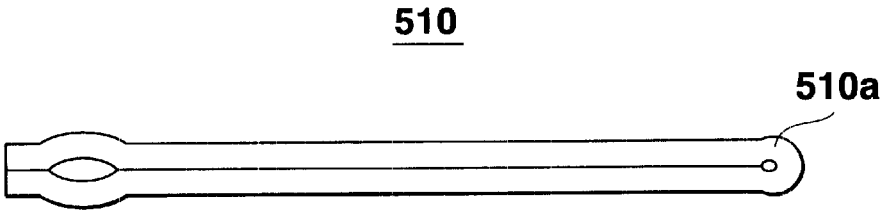
FIG. 11 is a view showing an inserting pin of the adapter for connecting an earphone.
Figure 12A:
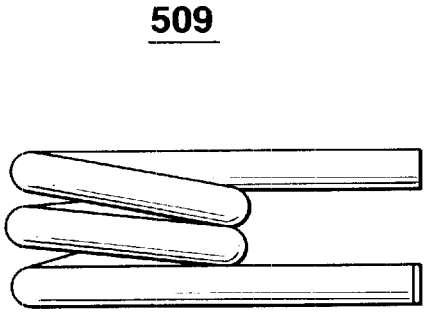
FIGS. 12A and 12B are views showing a torsion coil spring of the adapter for connecting an earphone.
Figure 12B:
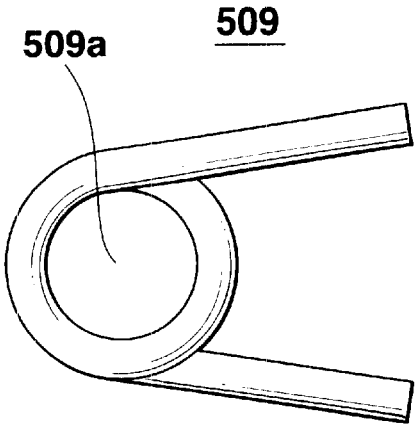

As shown in the transverse sectional view of FIG. 10, the lower casing 503 comprises a concavity 503*a* for holding the earphone jack 504 received into one end side surface side of the lower casing 503.

That is, when the earphone jack 504 is held by the concavity 503*a* of the lower casing 503, the earphone jack 504 is prevented from falling out from the casing 501 by holding it with the side wall 502*a*.

As shown in FIGS. 1 and 7, the earphone jack 504 is held so that the earphone terminal 601 is inserted and extracted in a direction approximately parallel to a longitudinal direction of the wrist bands 301 and 302 when the adapter 500 for connecting an earphone is attached to the body part 200. Therefore, when a user wears the wrist type of music player 100 on user's wrist and the earphone terminal 601 is connected with the earphone jack 504, it is hard that the earphone terminal 601 hits on user's forearm in comparison with the case that the earphone terminal 601 is inserted and extracted in a direction perpendicular to a longitudinal direction of the wrist bands 301 and 302, and the earphone terminal 601 is not obstructive to wearing the wrist type of music player 100.

As shown in FIGS. 8 and 10, in the holes 503*b* of the lower casing 503, a step portion 503*c* is formed by thinning the hole 503*b* on the way from the upper surface side to the lower surface side. A bottom portion 506*a* of the connection terminal 506*c* is spread more than a pin body, and is caught on the step portion 503*c*. In the hole 503*b*, a coil spring 506 made of metal is provided so as to sandwich it between the circuit board 505 and the bottom portion 506*a*.

That is, the connection terminal 506 projects from the hole 503*b* toward the outside of the casing 501 by a biasing force of the coil spring 506*b*. Further, the connection terminal 506 is prevented from falling out from the hole 503*b* by catching the bottom portion 506*a* on the step portion 503*c*.

As shown in FIGS. 8 and 10, a groove is formed on a peripheral surface of the connection terminal 506. An O-ring 503*d* (waterproof member for a terminal) is attached to the groove. The O-ring 503*d* is firmly fixed to the hole 503 and the connection terminal 506. Water is prevented from entering the casing 501 from the holes 503*b*.

As shown in FIGS. 8 and 10, on the upper surface of the lower casing 503, that is, on the surface which is in contact with the circuit board 505, a groove 503*e* enclosing all of the holes 503*b* and an O-ring 503*f* (waterproof member) crammed into the groove 503*e* are provided. The O-ring 503*f* is firmly fixed to the groove 503*e* and the circuit board 505. Water is prevented from entering the casing 501 from the earphone jack 504 side.

As shown in FIGS. 8 and 10, the fixed hook 507 is one in which a hook portion 507*a* projects toward the movable hook 508.

As shown in FIG. 8, the movable hook 508 comprises a through hole which is a center of rotation of the movable hook 508. A recess (not shown in the figure) for receiving the torsion coil spring 509 is provided on a part of the side surface of the movable hook 508, which is on the fixed hook 507 side, so as to traverse the through hole.

The movable hook 508 is attached to the casing 501 so that a hook portion 508*a* projects more downwardly than the lower surface of the casing 501.

As shown in FIG. 10, a concavity 503*g* for receiving the movable hook 508 and holes 503*h* formed on both side surfaces of the concavity 503*g* and on the same axis are provided on the other end side surface of the lower casing 503. One hole 503*h* penetrates through one side surface of the concavity 503*g*. The other hole 503*h* is closed on the way from an inner wall of the other side surface.

That is, the movable hook 508 is attached to the casing 501 rotatably by inserting a head portion 510*a* of an inserting pin 510 (referred to FIG. 11) which is inserted into the one hole 503*h* penetrating through one side surface of the concavity 503*g* and which penetrates through the concavity 503*g*, into the through hole. When the torsion coil spring 509 (referred to the side view shown in FIG. 12A and the plan view shown in FIG. 12B) is received into the recess provided on the side surface of the movable hook 508, the center 509*a* of the torsion coil spring 509 is penetrated by the inserting pin 510. As a result, the torsion coil spring 509 is attached to a predetermined position.

Figure 13A:
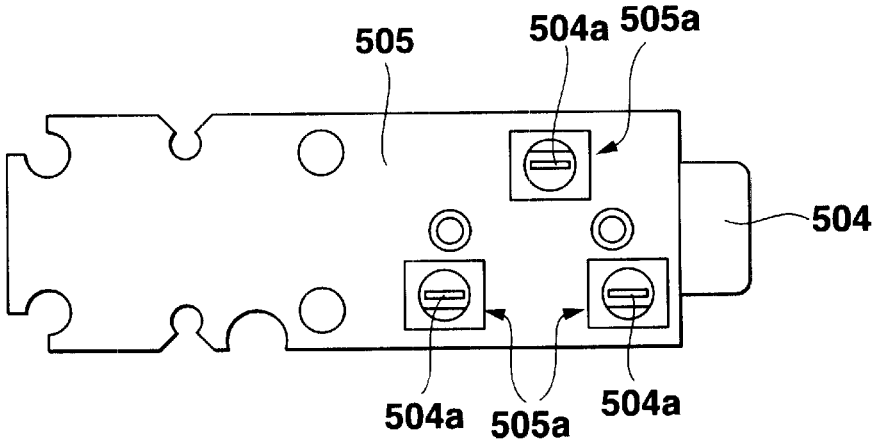
FIGS. 13A to 13C are views showing a circuit board and an earphone jack, of the adapter for connecting an earphone.
Figure 13B:
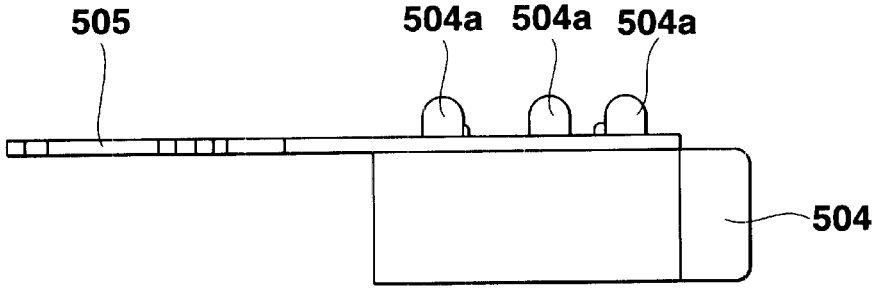
Figure 13C:
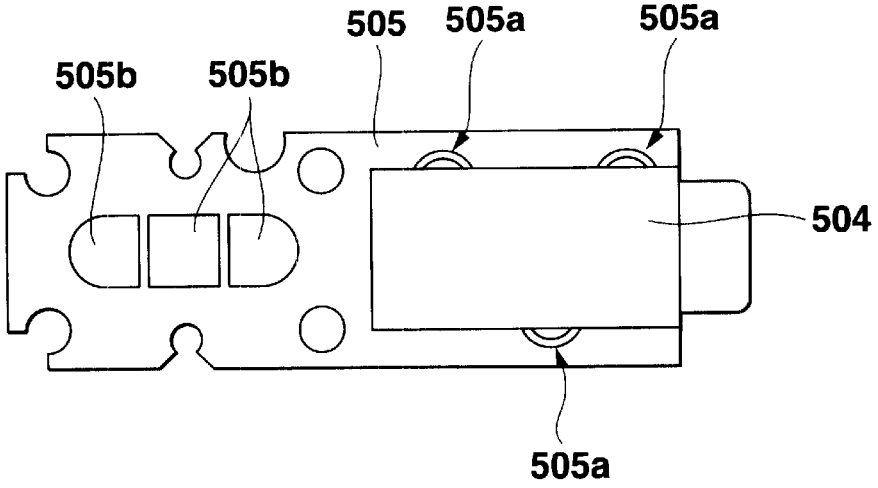

As shown in the plan view of FIG. 13A, the side view of FIG. 13B and the bottom view of FIG. 13C, the circuit board 505 is one formed approximately into a rectangle and made of insulating resin. Holes 505*a* for holding the terminal 504*a* of the earphone 504 by making the terminals 504*a* penetrate through the holes 505*a* are provided on one end side of the circuit board 505. Connecting points 505*b* for electrically connecting with the connection terminals 506 through the coil spring 506*b* are provided on the other end side of the circuit board 505. The circuit board 505 has the holes 505*a* and the connecting points 505*b* in the necessary number, respectively.

Leads (not shown in the figure) for connecting each terminal 504*a* with respective connecting points 505*b* are built into the circuit board 505.

The adapter 500 for connecting an earphone having such a structure is assembled according to the following process.

That is, the connection terminals 506 with the O-ring 503*d* and the coil springs 506*d* are inserted into the holes 503*b* of the lower casing 503 into which the movable hook 508 and the torsion coil spring 509 are previously built. Then, the O-ring 503*f* is crammed into the groove 503*e*. The circuit board 505 to which the earphone jack 504 is soldered is disposed on the lower casing 503. The upper casing 502 and the lower casing 503 are incorporated by mechanical screws 500*a* (for example, referred to FIGS. 3 and 8). The casing 501 is formed so as to sandwich the circuit board 505.

In the wrist type of music player 100 having such a structure, when a music is reproduced to listen to the reproduced music, the adapter 500 for connecting an earphone is connected with the body part 200 at a touch according to the following procedure.

That is, as a procedure partially shown in FIG. 6, after the fixed hook 507 is engaged with the concavity 200*a* of the body part 200, the whole adapter 500 for connecting an earphone is rotated around the fixed hook 507 toward the body part 200 in order to fit the movable hook 508 into the concavity 200*b*. After the movable hook 508 is fit into the concavity 200*b*, the movable hook 508 is firmly engaged with the concavity 200*b* by a biasing force of the torsion coil spring 509 elastically. The adapter 500 for connecting an earphone is fixed to the body part 200 by the movable hook 508 and the fixed hook 507.

When the adapter 500 for connecting an earphone is fixed to the body part 200, the connection terminals 506 are connected with the output terminals 205*a* of the earphone connector 205 of the body part 200. Then, the connection terminals 506 is pushed while the coil spring 506*b* is contracted. That is, the connection terminals 506 and the earphone connector 205 are electrically connected under a suitable contact pressure caused by a repulsive force of the coil spring 506*b*.

As a result, the body part 200 and the earphone 600 are firmly connected through the earphone connector 205, the connection. terminals 506, the coil springs 506*b*, the circuit board 505 and the earphone jack 504.

Because the wrist type of music player 100 is used by wearing it on user's wrist, there may be some possibility that the wrist type of music player 100 is exposed to rain or sweat. However, because the O-rings 503*d* and 503*e* are provided in the adapter 500 for connecting an earphone, drops of rain or those of sweat do not enter the casing 501 of the adapter 500 for connecting an earphone. Therefore, the durability and the reliability, of the connecting portion between the body part 200 and the earphone 600 are improved.

When the wrist type of music player is used only as a watch, the adapter 500 for connecting an earphone can be detached from the body part 200 at a touch according to the following procedure.

That is, the movable hook 508 is disengaged from the concavity 200*b* of the body part 200 by pushing the movable hook 508. The adapter 500 for connecting an earphone is rotated around the fixed hook 507 in a direction apart from the body part 200. Then, the fixed hook 507 is disengaged from the concavity 200*a*.

Therefore, in comparison with a structure in which the earphone is directly inserted into the wrist type of music player, the wrist type of music player can be used in a state that the wrist type of music player is downsized more and is more portable.

The present invention is not limited to the above-described embodiment. Various changes and modifications may be made to the present invention without departing from the gist thereof.

Figure 14:
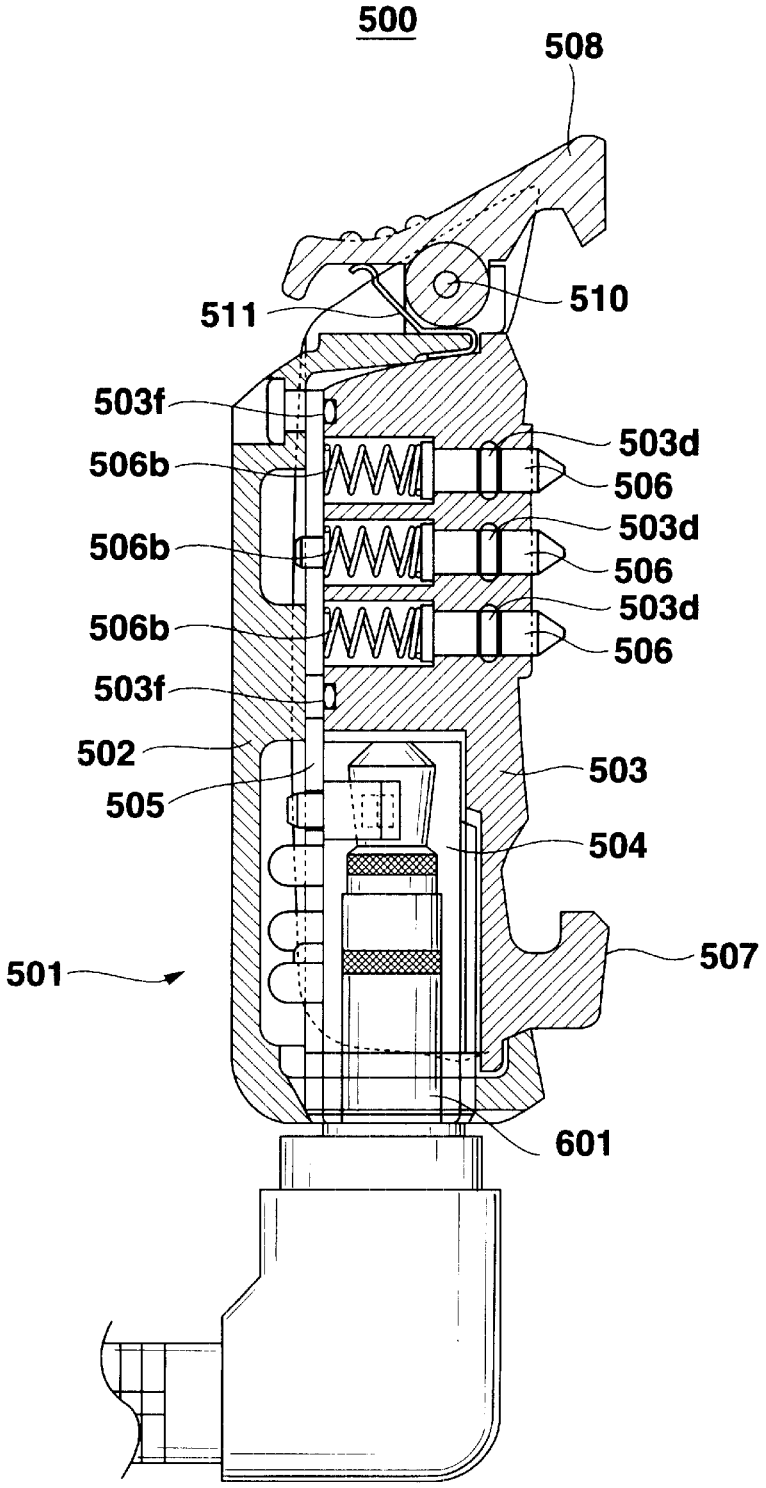
FIG. 14 is a transverse sectional view of one modified example of the adapter for connecting an earphone.

For example, as shown in FIG. 14, even though a plate spring 511 (spring member) formed approximately into a U-shape is used instead of the torsion coil spring 509, the same effect as the above-described embodiment can be obtained.

Figure 15:
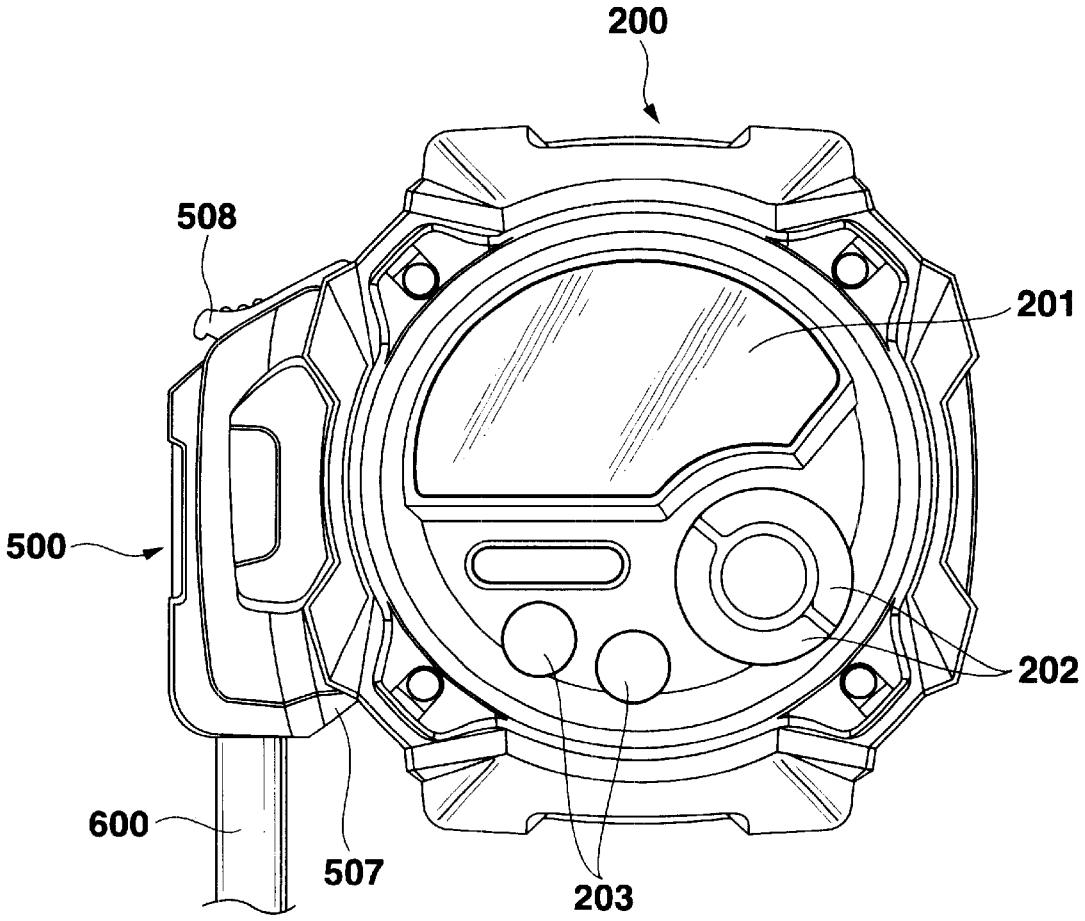
FIG. 15 is a plan view of another modified example of the adapter for connecting an earphone.

As shown in FIG. 15, even though the terminal 601 of the earphone 600 and the earphone jack 504 are removed and each wiring of the earphone 600 is fixedly connected with the terminals off t he circuit board, the same effect as the above-described embodiment can be obtained.

According to the adapter for external connection, of the present invention, by using the adapter for external connection, which mediates between the electronic apparatus and the external lead, even in a standardized connection structure, the connection structure between an electronic apparatus and an external lead can be changed while the convenience of the electronic apparatus is kept. Therefore, when the electronic apparatus is not used, it is possible to downsize the electronic apparatus by detaching the adapter for external connection.

Because it is possible that the lead is removed from the main part of the adapter for external connection, the adapter for external connection is more useful.

The external lead can be incorporated into the adapter for external connection.

Water cannot enter the adapter for external connection by the function of the waterproof member or by the function of both the waterproof member and the waterproof member for a terminal. Therefore, the adapter for external connection, which has a waterproof structure can be provided.

According to the electronic apparatus of the present invention, when the electronic apparatus is not used, the lead is easily removed from the electronic apparatus by detaching the adapter for external connection at a touch. Further, it is possible to downsize the body part of the electronic apparatus.

What is claimed is:

1. An adapter for external communication, comprising:

a connection terminal that contacts a terminal provided on a surface of a body part of an electronic apparatus when the adapter for external connection is attached to the body part of the electronic apparatus;

an external connection terminal which is electrically connected to the connection terminal and which is adapted to be electrically connected to an external lead inserted therein; and an attachment member that detachably attaches the adapter for external connection to the body part of the electronic apparatus;

wherein the attachment member comprises: (i) a pair of hooks for engaging with a pair of concavities formed on a side portion of the body part of the electronic apparatus in an outer peripheral direction of the body part, one of the pair of hooks being a movable hook provided on one end side of the adapter for external connection and the other of the pair of hooks being a fixed hook provided on the other end side of the adapter for external connection, and (ii) a biasing member that biases the movable hook toward the fixed hook to elastically engage the movable hook with one of the concavities formed on the side portion of the body part of the electronic apparatus;

wherein the connection terminal comprises a coil spring, and the coil spring provides a biasing force to the connection terminal so as to bias the connection terminal toward an output terminal of the body part of the electronic apparatus; and wherein the adapter further comprises a circuit board for electrically connecting the connection terminal with the external connection terminal, wherein the circuit board has a continuity with the connection terminal through the coil spring; and a waterproof member for preventing water from entering the adapter for external connection from the external connection terminal.

2. The adapter for external connection as claimed in claim 1, wherein a hook portion of the fixed hook projects toward the movable hook.

3. The adapter for external connection, as claimed in claim 1, wherein the external connection terminal is a lead terminal engaging portion for detachably receiving a lead terminal provided on an end portion of the external lead.

4. The adapter for external connection, as claimed in claim 1, where in the external connection terminal is a terminal which is fixedly connected with the external lead.

5. The adapter for external connection, as claimed in claim 1, wherein the connection terminal comprises a waterproof member for a terminal, for preventing water from entering the adapter for external connection.

6. An electronic apparatus comprising:

an adapter for external connection, comprising: (i) a connection terminal that contacts a terminal provided on a surface of a body part of the electronic apparatus when the adapter for external connection is attached to the body part of the electronic apparatus, (ii) an external connection terminal which is electrically connected to the connection terminal and which is adapted to be electrically connected to an external lead inserted therein, and (iii) an attachment member that detachably attaches the adapter for external connection to the body part of the electronic apparatus;

wherein the body part of the electronic apparatus comprises first and second concavities formed on a side portion of the body part of the electronic apparatus in an outer peripheral direction of the body part;

wherein the attachment member comprises: (i) a movable hook, provided on one end side of the adapter for external connection, for engaging with the first concavity of the body part of the electronic apparatus, (ii) a fixed hook, provided on the other end side of the adapter for external connection, for engaging with the second concavity of the body part of the electronic apparatus, and (iii) a biasing member for biasing the movable hook toward the fixed hook to elastically engage the movable hook with the first concavity of the body part of the electronic apparatus;

wherein the terminal provided on the surface of the body part of the electronic apparatus contacts the connection terminal of the adapter for external connection when the movable hook is engaged with the first concavity of the body part of the electronic apparatus;

wherein the connection terminal comprises a coil spring, and the coil spring provides a biasing force to the connection terminal so as to bias the connection terminal toward an output terminal of the body part of the electronic apparatus; and wherein the adapter further comprises a circuit board for electrically connecting the connection terminal with the external connection terminal, wherein the circuit board has a continuity with the connection terminal through the coil spring; and a waterproof member for preventing water from entering the adapter for external connection from the external connection terminal.

7. The electronic apparatus as claimed in claim 6, wherein the electronic apparatus is a portable type of electronic apparatus.

8. The electronic apparatus as claimed in claim 7, wherein the electronic apparatus is attachable to user's body.

9. The electronic apparatus as claimed in claim 6, wherein the body part of the electronic apparatus comprises a band for wearing the body part of the electronic apparatus on user's wrist.

10. The electronic apparatus as claimed in claim 9, wherein the external connection terminal is a lead terminal engaging portion for detachably receiving a lead terminal provided on an end portion of the external lead, and the lead terminal engaging portion is provided so that the lead terminal is inserted and extracted in a direction approximately parallel to a direction of the band when the adapter for external connection is attached to the body part of the electronic apparatus.

11. The adapter for external connection, as claimed in claim 1, wherein the attachment member further comprises a pin, and the movable hook is rotatable around the pin.

12. The adapter for external connection, as claimed in claim 11, wherein the biasing member comprises a torsion coil spring penetrated by the pin.

13. The electronic apparatus as claimed in claim 6, wherein the attachment member further comprises a pin, and the movable hook is rotatable around the pin.

14. The electronic apparatus as claimed in claim 13, wherein the biasing member comprises a torsion coil spring penetrated by the pin.

* * * * *